United States Patent [19]

Hobbs

[11] 4,008,968

[45] Feb. 22, 1977

[54] WASHING DEVICE

[76] Inventor: Leonard E. Hobbs, 710 N. Ocean Blvd., Apt. 410, Pompano Beach, Fla. 33062

[22] Filed: Oct. 10, 1975

[21] Appl. No.: 621,282

Related U.S. Application Data

[63] Continuation-in-part of Ser. No. 572,743, April 29, 1975, abandoned.

[52] U.S. Cl. ..... 401/207; 401/196; 401/183

[51] Int. Cl.[2] ..... B43M 11/06

[58] Field of Search ..... 401/196, 201–207, 401/183–186

[56] References Cited

UNITED STATES PATENTS

| | | | |
|---|---|---|---|
| 339,652 | 4/1886 | Horton | 401/183 |
| 1,518,341 | 12/1924 | Mendona | 401/286 |
| 2,742,660 | 4/1956 | Van Esley | 401/207 X |
| 3,690,779 | 9/1972 | Ellis | 401/287 X |
| 3,775,017 | 11/1973 | Jerry | 401/203 X |

FOREIGN PATENTS OR APPLICATIONS

| | | | |
|---|---|---|---|
| 1,203,889 | 8/1959 | France | 401/183 |
| 2,031,683 | 12/1971 | Germany | 401/196 |

*Primary Examiner*—Lawrence Charles
*Attorney, Agent, or Firm*—Wolf, Greenfield & Sacks

[57] ABSTRACT

The device is hand held, may be used for washing dishes and the like, and comprises a hollow handle that may be filled with a detergent, and a removable sponge. A small aperture in the bottom of the handle permits the detergent to seep into the sponge which may be eternally wetted for use.

6 Claims, 12 Drawing Figures

FIG. 5
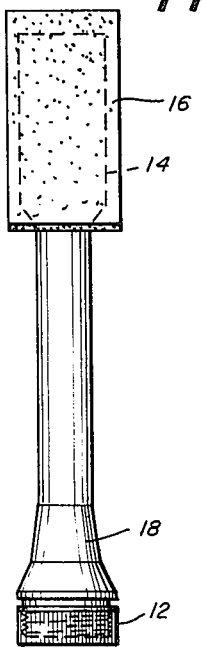
FIG. 6
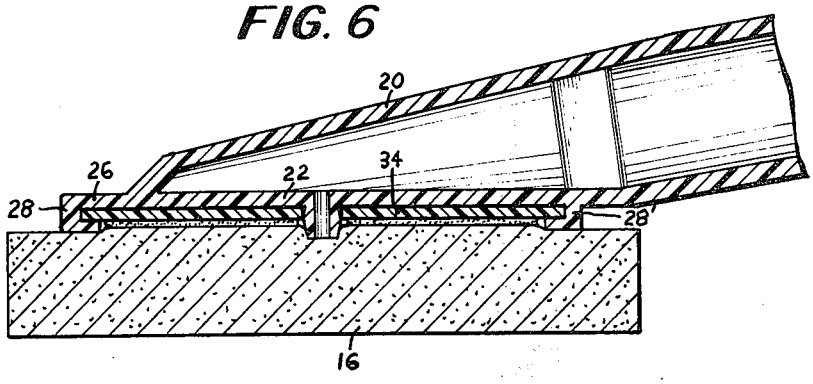
FIG. 7
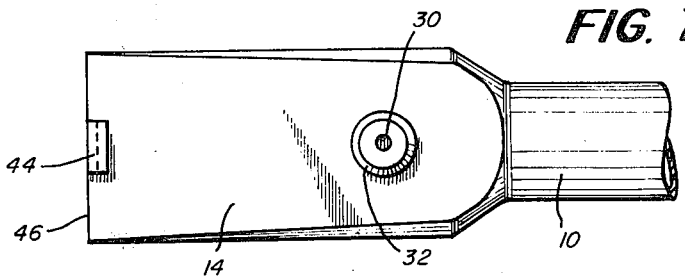
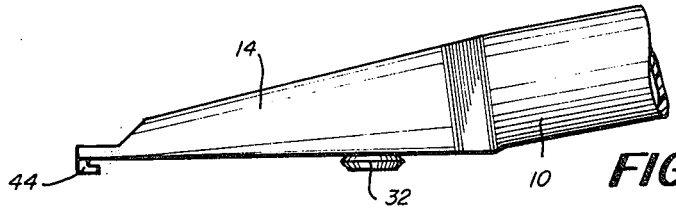
FIG. 8
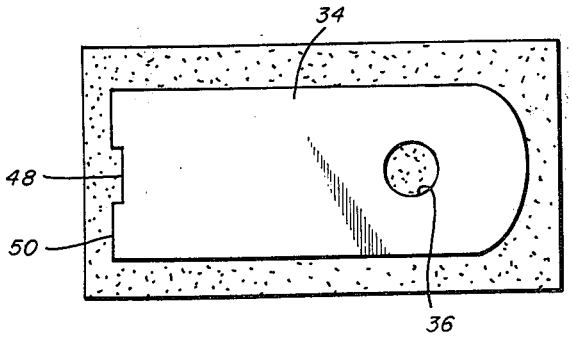
FIG. 9

WASHING DEVICE

RELATED APPLICATION

This application is a continuation-in-part of Application Ser. No. 572,743 filed Apr. 29, 1975, now abandoned.

BACKGROUND OF THE INVENTION

The present invention relates, in general, to washing devices and is concerned more particularly, with a handle type device having a sponge associated therewith typically used for washing dishes and the like.

There is a device that is commercially available that comprises an elongated cylindrical handle having a flattened end to which a small sponge is permanently glued. This device is hollow and the handle is provided with means for allowing a detergent to seep into the sponge. This device is effective in the washing of dishes but does have some drawbacks associated therewith. When the sponge has worn out, then the entire device must be discarded even though the handle structure certainly has not worn out. Also, with the prior art devices, many times the detergent that is put into the handle is not used entirely and the detergent that remains tends to seep into the sponge and is wasted.

Accordingly, one object of the present invention is to provide an improved washing device primarily for use in washing dishes and the like and which has a handle for holding the detergent and a removable sponge associated with the handle.

Another object of the present invention is to provide a washing device having a handle with a flared end permitting the device to stand upright. In this way, any detergent that might be left in the hollow handle is prevented from seeping into the sponge.

A further object of the present invention is to provide a dish washing device having a sponge with a support plate or the like associated therewith and which is easily snapped into position in the handle and yet also easily removable from the handle for replacement.

SUMMARY OF THE INVENTION

To accomplish the foregoing and other objects of this invention, there is provided a device that is preferably used for washing dishes and the like. This device comprises a handle that is hollow and has an opening at one end through which the detergent is poured for storing in the handle. A sponge is secured to the other end of the handle and for this purpose the handle is preferably somewhat flattened to receive the sponge. At this end the handle is provided with at least one small aperture for permitting the detergent to seep from the handle into the sponge. In accordance with this invention, the sponge is removable and in one embodiment the sponge is permanently secured to a mounting plate having an aperture therethrough. The handle has a small nozzle which interlocks with the hole in the mounting plate and the handle further comprises a flange or clip for receiving an edge of the mounting plate. In an alternate embodiment, the handle may terminate in a straight flat edge and the mounting plate may be provided with a flange or slip for accommodating the edge of the handle. In still another preferred embodiment the handle is provided with two spaced nozzles or spouts, one of which has a passage and the other of which is closed. These spouts alone secure the sponge mounting plate to the device.

BRIEF DESCRIPTION OF THE DRAWINGS

Numerous other objects, features and advantages of the invention should now become apparent upon a reading of the following detailed description taken in conjunction with the accompanying drawings, in which:

FIG. 5 shows the device of this invention in its upright position as when not in use;

FIG. 6 shows a cross-sectional view of another embodiment;

FIGS. 7, 8 and 9 show still another embodiment in accordance with this invention.

DETAILED DESCRIPTION

Figure 1:
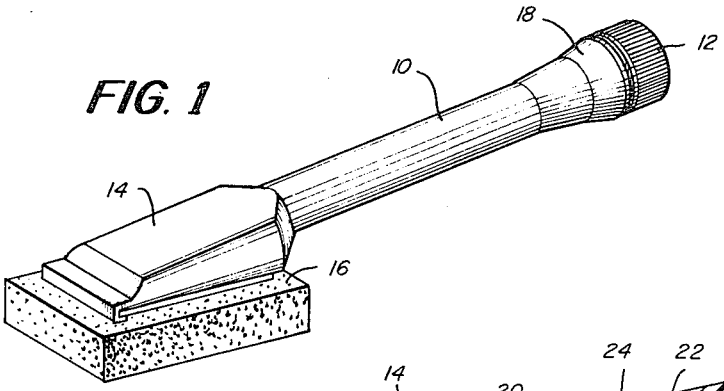
FIG. 1 is a perspective view of one embodiment for the device of this invention.

The perspective view of FIG. 1 shows the device of this invention which comprises a handle 10 having, at one end, a threaded portion for receiving the cap 12. At the other end of the handle 10 there is a widened base section 14 for receiving the rectangular shaped sponge 16. It is noted that the handle 10 is flared at 18. FIG. 5 shows the flared end 18 and the cap 12 which together define a base upon which the device can stand. Thus, if the device is still filled with some detergent, this detergent cannot seep into the sponge 16 with the device maintained in the position shown in FIG. 5.

Figure 2:
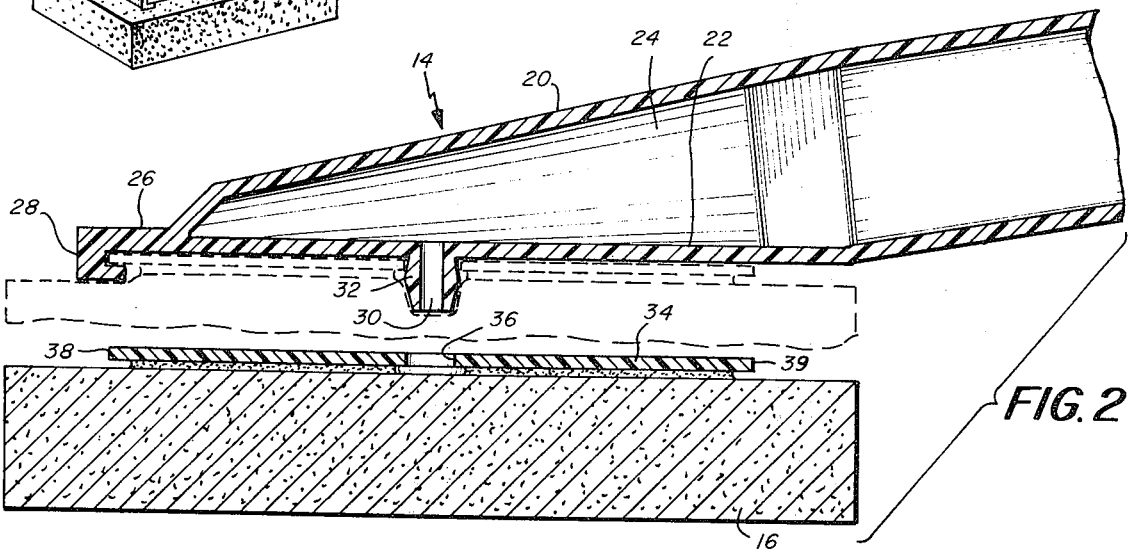
FIG. 2 is a cross-sectional view showing the handle and sponge separated from each other.

Referring to FIGS. 1 and 2, the widened base section 14 comprises opposite tapered walls 20 and 22. The space 24 between these walls 20 and 22 define a portion of the storage compartment for the detergent within the handle 10. The bottom wall 22 extends forwardly in an extension 26 with an L-shaped flange 28 extending from the extension 26. The flange 28, extension 26 and wall 22 may possibly be fabricated from a single piece of plastic.

The wall 22 also has an aperture 30 therein defining a spout 32 which extends below the bottom surface of the wall 22.

FIG. 2 shows the sponge 16 which may be of rectangular shape and cut from a large sponge blank. The sponge 16 has a plate 34 permanently affixed such as by gluing, thereto. The plate 34 has an aperture 36 for accommodating the spout 32. The spout 32 may have a slight annular ridge thereabout so that it snap fits with the aperture 36.

In order to lock the sponge and handle together, the front edge 38 of the plate 34 is secured into the flange 28 and then the sponge is rotated so that the spout 32 passes through the aperture 36 and locks with the aperture 36. In order to remove the sponge structure from the handle, a knife could be inserted between the plate 34 and the wall 22 to snap the spout from the aperture 36. Alternatively, a fingernail or thumb could be used to break the snap-fit between the spout 32 and aperture in the plate 34.

Figure 4:
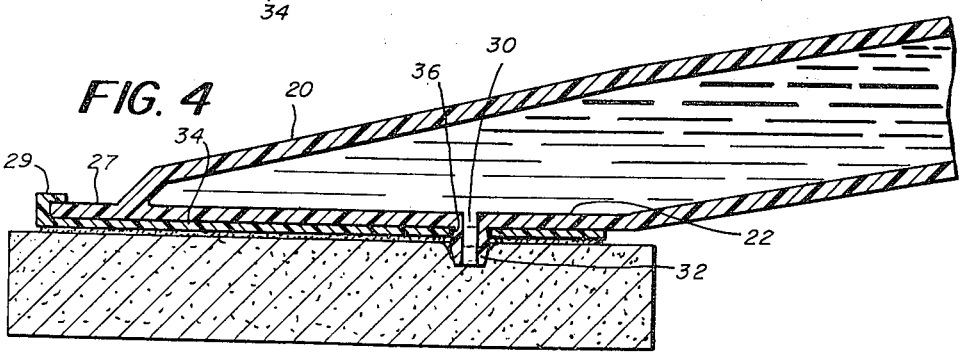
FIG. 4 is a cross-sectional view taken along line 4—4 of FIG. 3 with the handle and sponge secured together.

In the embodiment shown in FIG. 2, it is noted that the spout is disposed approximately in the center of the wall 22 so that the aperture 36 is almost in the center of the plate 34. In this way, the sponge can also be reversed so that the edge 39, for example, fits within the L-shaped flange 28. Also, the spout 32 may be provided spaced a larger distance from the flange 28 such as shown in FIG. 4. This may be preferred in some applications as it provides support at two more distant points.

In FIG. 6, like reference characters will be used to identify like parts identified in FIG. 2. The embodiment shown in FIG. 6 includes two opposite flanges 28 and 28' extending from opposite ends of wall 22. The forward flange 28 extends from the extension 26 in the same manner as shown in FIG. 2. With this arrangement, plate 34 may be flexed to fit between the two flanges with the spout 32 and aperture 36 actually providing a third support point.

Figure 3:
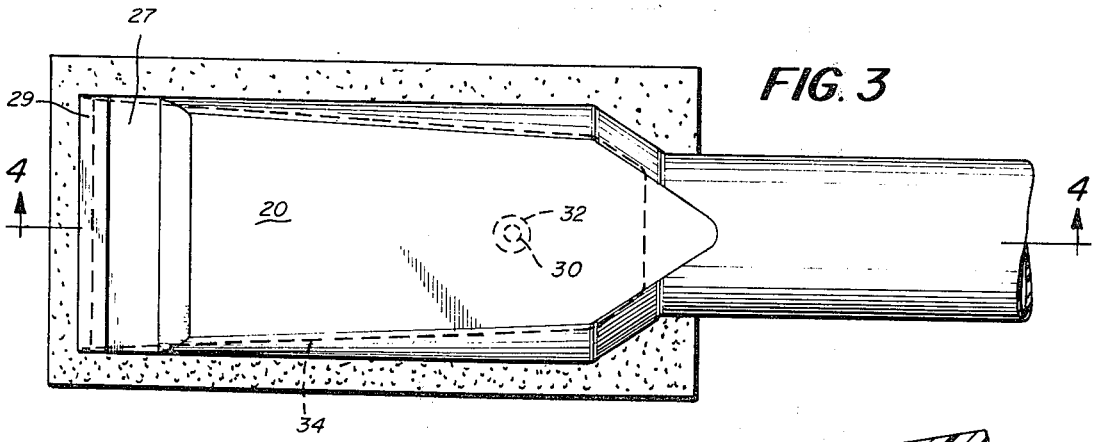
FIG. 3 is a plan view for an alternate embodiment of the device.

FIGS. 3 and 4 show another arrangement for fastening the sponge to the handle. In FIGS. 3 and 4 the same reference numerals will be used, as used in FIGS. 1 and 2 to identify like parts of the structure. Thus, the handle comprises walls 20 and 22 and the wall 22 defines an aperture 30 which, in turn, defines the spout 32. The forward end of the wall 22 terminates in a somewhat tapered extension 27. This extension 27 along with the flange 29 of the plate 34 forms an interlocking arrangement with the spout 32 and aperture 36. The arrangement shown in FIGS. 3 and 4 can be used in substantially the same way as the embodiment shown in FIGS. 1 and 2. The extension 27 is fitted within the flange 29 and then the sponge is rotated so that the spout fits within the aperture in the plate 34. The person's fingers or a knife can be used to separate the sponge structure from its handle. In the embodiments of FIGS. 2 and 4, it can be seen that the detergent can easily seep through the aperture 30 to the sponge when it is used. Alternatively, when the device is not to be used, it can be rested in the position shown in FIG. 5 with the detergent than not able to seep into the sponge. The cap 12 is, of course, removed for filling the handle with the detergent. The entire structure, with the exception of the sponge, can be made of a plastic material and the sponge can either be a natural or a synthetic sponge.

FIGS. 7–9 show still another embodiment of the present invention which is characterized by an improved interlocking between the handle and sponge carrier. In FIGS. 7–9, like reference characters will be used to identify parts that are like those shown in the other figures of the drawings.

FIG. 7 is a fragmentary view of the device in a front view showing the handle 10 and widened base section 14. In this embodiment the spout 32 defining the soap passage 30 is not centrally disposed but is disposed near one end of the section 14. Disposed at the further end of the section 14 is a flange 44 similar to the flange 28 shown in FIG. 2. However, this flange 44, as indicated in FIG. 7, extends only along a portion of the edge 46 and in FIG. 7 this flange is shown as extending along approximately a third of the portion of the edge and is centered along the edge 46. FIG. 8 also shows the flange 44 and the spout 32 in a side view.

FIG. 9 shows the plate 34 without a sponge secured thereto. The plate 34 is provided with an aperture 36 which snap-fits over the spout 32, shown in FIG. 7. At the other end of plate 34 there is provided a squared notch 48. The notch 48 is centered along edge 50 of the plate 34 and extends approximately the same distance as does the flange 44 shown in FIG. 7. With this arrangement, the notch 48 is inserted under the flange 44 and then the plate 34 is snap-fitted with the spout 32 fitting with the aperture 36 in the plate. This type of an arrangement shown in FIGS. 7–9 provides a more positive interlocking of the sponge to the handle.

Figure 10:
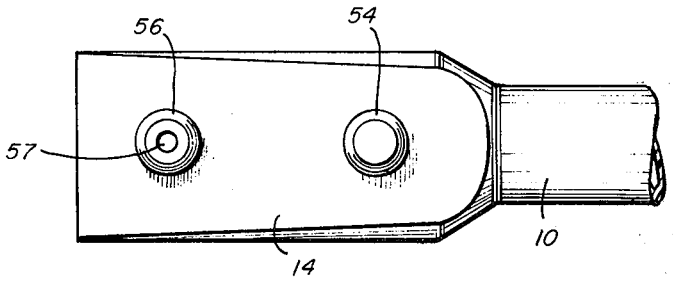
FIGS. 10, 11 and 12 show a preferred embodiment in accordance with the present invention.

FIG. 10 is a fragmentary view of the device in still another embodiment and in a front view showing the handle 10 and widened base section 14. In this embodiment, a flange such as the flange 44 shown in FIG. 7 is not necessary as there are provided two spouts 54 and 56. Preferably, only the spout 56 has a passage 57 through which the soap or detergent may pass to the sponge. The sponge is shown attached to the mounting plate 58 in FIG. 12. Both of the spouts 54 and 56 define an annular channel 60. The plate 58 is provided with two holes 61 which are spaced the same distance as the spouts 54 and 56. The holes 61 are provided with a predetermined diameter sufficient so that a snap-fit is provided when the plate 58 is forced over the spouts 54 and 56.

Figure 11:
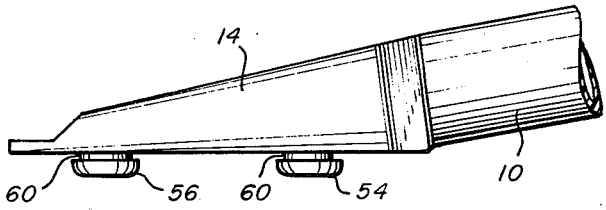
Figure 12:
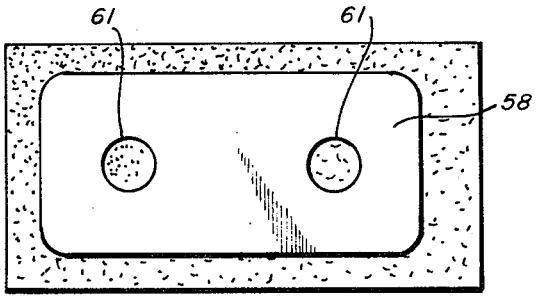

The embodiment shown in FIGS. 10–12 is believed to be of particular advantage in that the spouts function both as a spout and as a securing means for securing the sponge to the handle. The spout 56 is shown as having a passage for the detergent. When the item is sold, the spout 54 is closed but if one wishes to provide for more seepage of detergent into the sponge, then it is quite easy to puncture a hole in the spout 54. The spout 54 may even be provided with a partial recess so that only a relatively thin wall need be punctured to provide passage through the spout 54. The annular channel 60 actually defines an annular ridge just above the channel as shown in FIG. 11 so that the plate must be forced over the ridge and snapped in place secured in the channel 60.

Having described a limited number of embodiments for the present invention, it should now be obvious to those skilled in the art that numerous other embodiments are contemplated as falling within the scope of the present invention which is defined by the appended claims.

What is claimed is:

1. A washing device comprising, a hollow handle having means at one end for receiving a liquid cleaner and a relatively flat wall at the other end defining a flat outer surface having opposite ends, a spout having a passage therethrough and extending from the flat outer surface of the wall, said spout being disposed nearer one end of the flat outer surface, a spout-like member spaced from the spout disposed nearer the other end of the flat outer surface and extending from the flat outer surface, a relatively thin flat plate having a sponge secured thereto, said plate having a pair of apertures spaced the same distance as the spout and spout-like member, one aperture for receiving the spout with the spout extending through the one aperture below the plate and contacting the sponge, the other aperture for receiving the spout-like member with the member extending through the other aperture below the plate and contacting the sponge, both said spout and spout-like member providing securing means in combination with the apertured plate for holding the plate and attached sponge to the handle.

2. A washing device as set forth in claim 1 wherein both the spout and spout-like member have a maximum diameter slightly larger than the diameter of the apertures to provide a snap fit therebetween.

3. A washing device as set forth in claim 2 wherein both said spout and spout-like member are of substantially identical shape except that said member is closed.

4. A washing device as set forth in claim 3 wherein said spout and spout-like member each have an annual channel defining a head with the heads both entirely extending from the plate into contact with the sponge.

5. A washing device as set forth in claim 1 wherein said spout and spout-like member each have an annular channel defining a head with the heads both entirely extending from the plate into contact with the sponge.

6. A washing device as set forth in claim 1 wherein said spout has an annular channel defining an annular ridge for providing a snap fit between the spout and plate.

* * * * *